United States Patent [19]

Talley

[11] 3,949,674

[45] Apr. 13, 1976

[54] OPERATION OF FRAGMENT CORE WARHEAD

[75] Inventor: James C. Talley, Dahlgren, Va.

[73] Assignee: The United States of America as represented by the Secretary of the Navy, Washington, D.C.

[22] Filed: Oct. 22, 1965

[21] Appl. No.: 502,711

[52] U.S. Cl. ..... 102/67; 102/56

[51] Int. Cl.[2] ..... F42B 13/48

[58] Field of Search ..... 102/56–59, 102/63, 67, 68, 70.2

[56] References Cited

UNITED STATES PATENTS

| | | | |
|---|---|---|---|
| 2,925,965 | 2/1960 | Pierce | 102/70.2 P |
| 3,136,251 | 6/1964 | Witow | 102/67 |
| 3,263,612 | 8/1966 | Throner | 102/67 |
| 3,298,308 | 1/1967 | Throner | 102/67 |
| 3,298,309 | 1/1967 | Philipchuk | 102/67 |

*Primary Examiner*—Verlin R. Pendegrass

[57] ABSTRACT

A cylindrical warhead having a central core of fragments and a radially segmented burst charge encompassing the fragment core. A plurality of separation charges are disposed between the burst charge segments and function to remove without detonating the charge segments oriented toward the target whereby the fragment core has an unimpeded path toward the target when the remaining segments are detonated.

8 Claims, 5 Drawing Figures

INVENTOR
JAMES C. TALLEY

BY Claude Funkhouser
ATTORNEY

OPERATION OF FRAGMENT CORE WARHEAD

The invention described herein may be manufactured and used by or for the Government of the United States of America for governmental purposes without the payment of any royalties thereon or therefor.

This invention relates to a warhead fragmentation system and more particularly to a method and means for making the fragmentation charge in a warhead highly directional and of greater mass velocity and range than has heretofore been possible.

It is not uncommon for an anti-aircraft missile not to make direct contact with the target aircraft. In such a case, it is desirable that a near-miss not result in failure, and the target aircraft can be destroyed if the missile is called upon to explode while it is near the target and propel fragments or charges against the aircraft in a destructive manner. To accomplish this, a sensing or proximity system is provided as a part of the missile fire control system to indicate to the missile when it is within range of the target aircraft, and at the proper moment command the warhead to explode, causing shrapnel or shell fragments to hit the target.

In the prior devices, the fragmentation portion of the warhead has generally been fired out in all directions from the missile. Although this insures complete circular coverage, there is no real aiming of the fragments and, therefore, all except those few fragments which are in the sector of the target aircraft are wasted and that portion of the burst charge which has been used to propel fragments in directions other than toward the target aircraft is wasted. Application Ser. No. 502,712, filed Oct. 22, 1965, "Fragment Core Warhead," by James C. Talley et al, now U.S. Pat. No. 3,757,694, issued Sept. 11, 1973, sets forth a great advance in the art by constructing and operating a warhead in such a manner that practically the full force of the explosion is directed at the target. This is accomplished by placing the destructive fragments in a central core, with the burst charge located therearound. That portion of the burst charge in the direction of the target is jettisoned, allowing a clear path for the fragment core, propelled by the remainder of the burst charge, to move toward the target. By the instant invention, an improved method and means for aiming the shrapnel and concentrating the burst of a fragment core warhead is provided. This is accomplished by constructing the burst charge in a plurality of radially segmented sections. Disposed between each of the adjacent sections of the burst charge is a small separating charge of sheet explosive. The explosion of one of these separating charges will cause the two adjacent sections of the burst charge to be folded outward. The sections of the burst charge so acted upon are those which are in the direction of the target aircraft. The subsequent explosion of the remainder of the burst charge propels the fragments section of the warhead toward the target aircraft through the area from which the sections of the burst charge have been folded away. Thus, the entire remainder of the explosive energy of the warhead is concentrated in a single direction, intensifying the blast toward the target aircraft.

It is an object of the present invention to provide an explosive warhead in which the force of the explosion can be aimed.

It is another object of the present invention to provide a fragmentation type warhead in which the fragments are propelled only in the direction of the target.

Still another object of the present invention is to provide a warhead in which the force of the explosion is aimed by exploding only a portion of the burst charge.

Other objects, advantages and novel features of the present invention will become apparent from the following detailed description of the invention when considered in conjunction with the accompanying drawings wherein.

Figure 1:
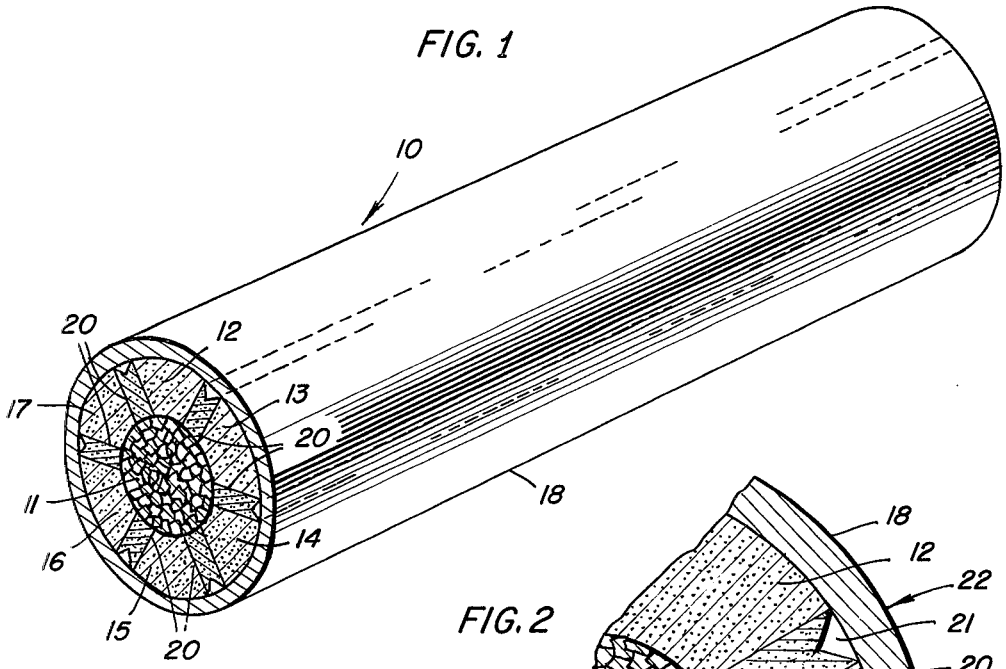
FIG. 1 is an overall diagrammatic view of a warhead constructed in accordance with the invention.
Figure 2:
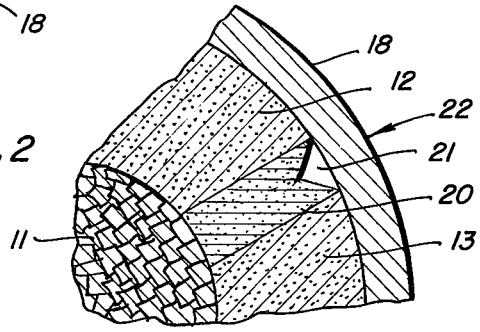
FIG. 2 is a detailed showing of the edge portion of a separating charge of the invention.
Figure 3:
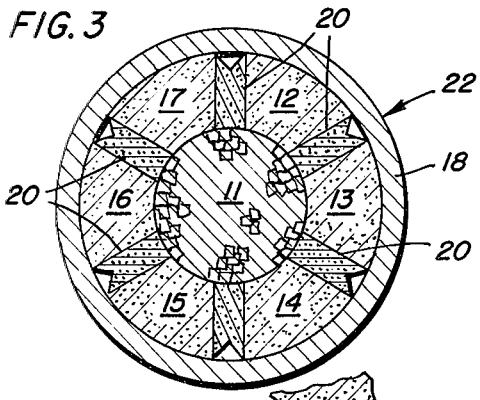
FIG. 3 is an end view of the device of FIG. 1.

Referring now to the drawings, the warhead 10 constructed by the present invention is comprised of a central fragmentation core 11 which may be of any design, surrounded by a segmented burst charge, shown for illustrative purposes as being made of six segments, 12, 13, 14, 15, 16 and 17. This burst charge may be of any type of powder and any advantageous grain configuration. The details of construction of the fragmentation section and the burst charge form no part of the present invention. Interposed between each of the adjacent sections of the burst charge is a plurality of separating charges 20, which are made of a sheet explosive. There is one separating charge 20 between each of the adjacent segments of the burst charge. These separating charges 20 extend longitudinally for the entire length of the warhead and are of such power as to cause adjacent burst charge segments to separate and fold outward without exploding. The entire warhead structure may be surrounded by a metal skin 18, and in order to also remove this skin from the path of the fragments of the warhead, a novel means incorporating the separating charges is used. The outboard edges of separating charges 20 are constructed of a shaped charge design 21 as shown in FIG. 2. It is the function of this shaped charge 21, which runs longitudinally along the entire length of the separating charge, to cause the metal casing 18 to be broken open at 22 and peeled back by the explosion of separating charge 20. Shaped charge portion 21 may be of any design which would accomplish the task involved and such design forms no part of the present invention.

Figure 4:
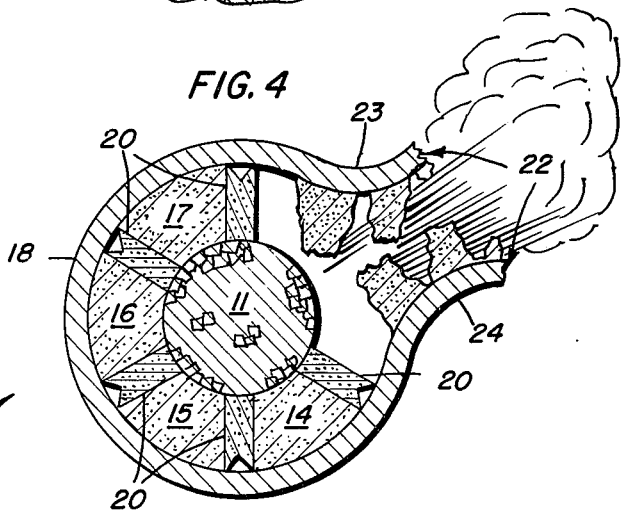
FIG. 4 is an end view illustrating the invention in the initial stages of operation.
Figure 5:
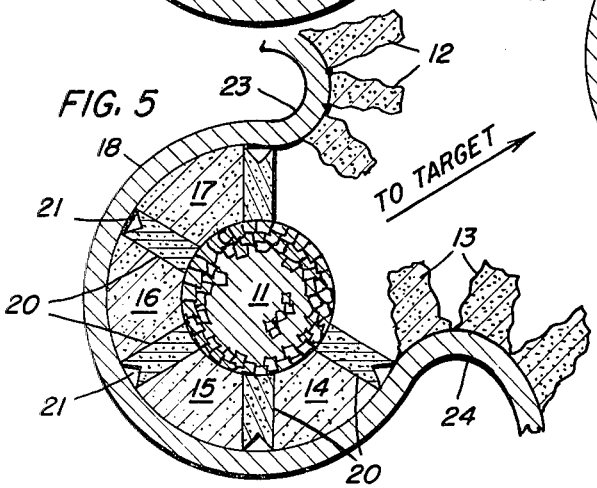
FIG. 5 is an end view illustrating the invention at the completion of its operation.

In operation, the warhead of the present invention is incorporated into a standard air defense missile, the construction of which forms no part of the present invention. Used with the warhead is a means for sensing the presence of a target aircraft and its direction from the missile, which sensing means can be missile-contained or can be a part of the missile fire control system on the ground or ship. When the missile is in the terminal stages of its flight, and is within a predetermined distance of the target, the target direction is sensed by the fire control system. This information is then transmitted to the electrical devices which explode the proper separating charge in the missile to move aside the two segments of the burst charge which are nearest the target. For the purpose of illustration and as shown in FIGS. 2 through 5, these are sections 12 and 13. The explosion of the separating charge 20 located between burst charge segments 12 and 13 first causes the metal protective cover 18 to be opened along a line 22 due to the action of shaped charge section 21, as shown in FIG. 4. The action of the explosion of separating charge 20 then causes segments 12 and 13 of the burst charge to separate and to fold outward along lines 23 and 24, eventually to the position shown in FIG. 5. The path of the fragmention core 11 to the target aircraft is now unobstructed and the subsequent explosion of the remainder of the burst charge segments 14, 15, 16 and 17 will concentrate a force on fragmentation core 11 which will cause the fragments to be thrown in the direction of the target aircraft. Since the fragments in core 11 are unobstructed by any portion of the burst charge, a much greater range is obtained and a greater mass of fragments is thrown at the target. The guided missile which carries the warhead of the present invention, the missile fire control system which is used to sense the target, and the electrical components in the missile and warhead itself which cause the detonation of the proper separation charge and the subsequent detonation of the remainder of the burst charge, are of standard design, well-known in the art, and form no part of the present invention.

It is thus seen that the present invention provides a new and relatively simple method for concentrating the destructive effect of a warhead in the direction of the target aircraft, thus providing a high kill potential with a minimum amount of energy waste.

Obviously many modifications and variations of the present invention are possible in the light of the above teachings. It is therefore to be understood that within the scope of the appended claims the invention may be practiced otherwise than as specifically described.

What is claimed is:

1. A warhead for a guided missile comprising a fragmentation core;

a radially segmented burst charge surrounding said fragmentation core, each segment of said segmented burst charge being adapted to be folded outwardly from said core; and means for folding a predetermined pair of adjacent segments of said segmented burst charge outwardly from said core, whereby upon the folding outwardly of said predetermined pair of adjacent segments, the subsequent explosion of the remaining segments of said segmented burst charge will cause said fragmentation core to be propelled through the space vacated by said predetermined pair of adjacent segments.

2. The structure of claim 1 wherein said means for folding comprises a plurality of separation charges, each separation charge being positioned between and in aligment with an adjacent pair of segments of said segmented burst charge, whereby the firing of one of said plurality of separation charges will cause said adjacent pair of segments to be separated and folded out of said warhead.

3. The structure of claim 2 wherein each of said separating charges comprise a sheet explosive sandwiched between said adjacent pair of burst charge segments and extending longitudinally for the entire length thereof.

4. The structure of claim 3 wherein said warhead further comprises a protective cover surrounding and enclosing said warhead and wherein each of said separation charges includes a shaped charge section located on the outer edge thereof extending longitudinally for the entire length thereof, whereby explosion of said separation charge will cause said shaped charge section to cut open said protective cover for its entire length allowing said pair of adjacent burst charge segments to be folded out.

5. A warhead for guided missiles comprising a cylindrical fragmentation core;

a cylindrical radially segmented burst charge coaxially disposed about said fragmentation core, each segment being adapted to be folded outwardly from said core; and a plurality of sheet explosive separation charges interposed between and aligned with adjacent segments of said segmented burst charge, each of said separation charges being adapted to fold the pair of adjacent segments of said burst charge outward from said core, whereby the firing of a single separating charge will cause the adjacent pair of burst charge segments to be folded outwardly from said core.

6. The structure of claim 5 wherein said warhead further comprises a cylindrical protective cover coaxially disposed about said segmented burst charge and enclosing said warhead and wherein each of said separation charges includes a shaped charge section located on the outer edge thereof and extending longitudinally for the entire length thereof, whereby explosion of said separation charge will cause said shaped charge section to cut open said protective cover for its entire length allowing said pair of adjacent burst charge segments to be folded out.

7. A method for aiming the destructive fragments of a warhead having a center fragmentation core surrounded by a burst charge comprising folding outwardly from the core that segment of the burst charge nearest the target; and exploding the remainder of the burst charge whereby the force of the explosion will cause the fragmentation core to be moved in the direction of the target through the area vacated by that segment of the burst charge which was folded outwardly.

8. A method for aiming the destructive fragments of a warhead having a center fragmentation core surrounded by a burst charge and a protective cover comprising cutting the protective cover open for its entire length at that point closest to the target;

folding outwardly from the core that segment of the burst charge which is adjacent to the opening in the protective cover; and exploding the remainder of the burst charge, whereby the force of the explosion will cause the fragmentation core to be moved in the direction of the target through the area vacated by the segment of the burst charge which was folded outwardly.

* * * * *